US005286215A

United States Patent [19]

Dewey et al.

[11] Patent Number: 5,286,215

[45] Date of Patent: Feb. 15, 1994

[54] MAKE-BEFORE-BREAK PC BOARD EDGE CONNECTOR

[75] Inventors: James D. Dewey, Plymouth; John M. Stasny, St. Paul; George B. Pfeffer, Minnetonka; Ernest R. Beaudet, Brooklyn Park, all of Minn.

[73] Assignee: ADC Telecommunications, Inc., Minneapolis, Minn.

[21] Appl. No.: 961,498

[22] Filed: Oct. 15, 1992

[51] Int. Cl.[5] ..... H01R 29/00

[52] U.S. Cl. ..... 439/188; 439/59; 439/630

[58] Field of Search ..... 439/59-62, 439/188, 629-632; 200/51.09, 51.1

[56] References Cited

U.S. PATENT DOCUMENTS 4,087,151 5/1978 Robert et al. .
4,106,841 8/1978 Vladic .
4,286,121 8/1981 Olszewski et al. .
4,514,030 4/1985 Triner et al. .
5,040,991 8/1991 Collier ..... 439/60
5,052,936 10/1991 Biechler et al. ..... 439/60
5,098,306 3/1992 Noschese et al. ..... 439/188
5,162,002 11/1992 Regnier ..... 439/60 X

FOREIGN PATENT DOCUMENTS 2133938 8/1984 United Kingdom .

*Primary Examiner*—Larry I. Schwartz
*Assistant Examiner*—Khiem Nguyen
*Attorney, Agent, or Firm*—Merchant, Gould, Smith, Edell, Welter & Schmidt

[57] ABSTRACT

A make-before-break edge connector receives an edge portion of a printed circuit board of predetermined thickness. The edge connector includes first and second spring contacts disposed as an opposing pair. Each of the spring contacts includes an entrance end, an intermediate portion and a termination end. At the intermediate portion, the spring contacts include normally closed spring contacts. At the entrance end, the spring contacts include normally open spring contacts.

4 Claims, 5 Drawing Sheets

MAKE-BEFORE-BREAK PC BOARD EDGE CONNECTOR

BACKGROUND OF THE INVENTION

1. FIELD OF THE INVENTION

This invention pertains to an edge connector for a printed circuit board. More particularly, this invention pertains to a make-before-break edge connector.

2. DESCRIPTION OF THE PRIOR ART

Make-before-break edge connectors for printed circuit boards are well known. An example of such is shown in U.S. Pat. No. 4,087,151 to Robert et al. dated May 2, 1978. As best illustrated in FIGS. 1–3 of the '151 patent, the make-before-break connector is a normally-closed electrical connector. Namely, electrical connection is made through the connector in the absence of an inserted circuit board (as shown in FIG. 1 of '151 patent). Upon partial insertion of printed circuit board into the connector, the connector first makes electrical connection with the printed circuit board before breaking the normal through electrical connection in the connector. The make-before-break position is shown in FIG. 2 of the '151 patent with the circuit made to the printed circuit board before being broken through the connector. FIG. 3 of the '151 patent shows full insertion of printed circuit board into a connector with the circuit made through the connector and broken through the connector.

Additional make-before-break connectors are shown in U.S. Pat. Nos. 4,286,121 and 4,106,841, and UK Patent Application GB 2133938A. A make-before-break connector (referred to as a "shorting edge connector") is also shown in U.S. Pat. No. 4,514,030 dated Apr. 30, 1985 to Triner et al. In the '030 patent, two opposing spring contacts 28,30 include normally closed contact ends 40,40' and normally closed contact portions 46,46'. Between contact portion pairs 40,40' and 46,46' is a spacing 42,42'. The spacing is slightly smaller than the thickness of an edge of a printed circuit board to be inserted into the connector. FIGS. 4A–4C of the '030 patent illustrate the make-before-break operation of the connector. FIG. 4A shows the connector in an absence of a printed circuit board. In this state, electrical connection is made between contacting pairs 46,46' and 40,40'. Upon partial insertion of a printed circuit board (as shown in FIG. 4B of '030 patent), the printed circuit board passes between pairs 40,40' resulting in electrical contact (i.e. a "making" of a circuit) with electrical contacts (not shown) on the printed circuit board. Further insertion of the printed circuit board into the contact results in the printed circuit board increasing the separation between surfaces 42,42' (as shown in FIG. 4C of the '030 patent). This increase in separation results in separation of the contacts 46,46'. Hence, the normal through circuit through the connector is now broken with the only connection being made through the printed circuit board and any circuit which might happen to be contained on the printed circuit board.

There is a continuing need for development of improved make-before-break connectors notwithstanding the current state of the art. Such connectors should have high reliability to prevent premature breaking of the circuit through the connector. For example, with reference to U.S. Pat. No. 4,514,030, the connector is commonly contained within a housing 10 of insulated' material such as plastic and the like. With the structure as shown in the '030 patent, a single contact point of each connector (in the vicinity of bends 38,38') bears against the walls of the housing 10. As a result, due to the resiliency of the spring contacts of the connector, a force is constantly being applied to an isolated location on the plastic walls. In response to the continued presence of such a force, the plastic material may creep or otherwise plastically deform resulting in movement of the spring contacts into the wall. The plastic deformation and creep is particularly heightened during high temperature applications. If this were to occur, the contact portions 46,46' may prematurely separate resulting in an undesired break of the circuit through the connector. Also, the close touching proximity portions 40,40' in the '030 patent, results in a required large displacement of the bends 40,40' upon insertion of a printed circuit board. Namely, the portions 40,40' must each be deflected about half the complete thickness of the printed circuit board. The greater the deflection required, the greater the force applied against the plastic housing 10 which increases the possibility of plastic deformation. Further, the increased displacement results in increased stresses on the bend portions 38,38' which increases the probability of failure of the springs.

It is an object of the present invention to provide an improved make-before-break connector.

SUMMARY OF THE INVENTION

According to a preferred embodiment of the present invention, an edge connector for receiving an edge portion of a printed circuit board of predetermined thickness is provided. The edge connector includes first and second contacts disposed as an opposing pair. Each of the first and second contacts include an entrance end, an intermediate portion and a termination end. In the intermediate portion, each of the contacts include normally closed spring contacts extending from body portions to spring portions with the spring portions resiliently biased into electrical contact. At the termination end, each of the first and second contacts include terminating members electrically connected to the body portions of the first and second spring contacts. At the entrance end, each of the first and second contacts include normally open spring contacts. The spring contacts include support portions connected to the body portions of the normally closed spring contacts. The normally open spring contacts also include spring portions which are disposed in a spaced apart relation with a spacing selected to be less than the predetermined thickness of the edge of the printed circuit board. The normally closed spring contacts and the normally open spring contacts are mutually aligned for an edge of the printed circuit board to be inserted into the connector with the edge first passing between the open spring contacts and making electrical contact with the open spring contacts. Upon further insertion, the edge passes between and separates the first and second normally closed spring contacts.

DESCRIPTION OF A PREFERRED EMBODIMENT

Figure 1:
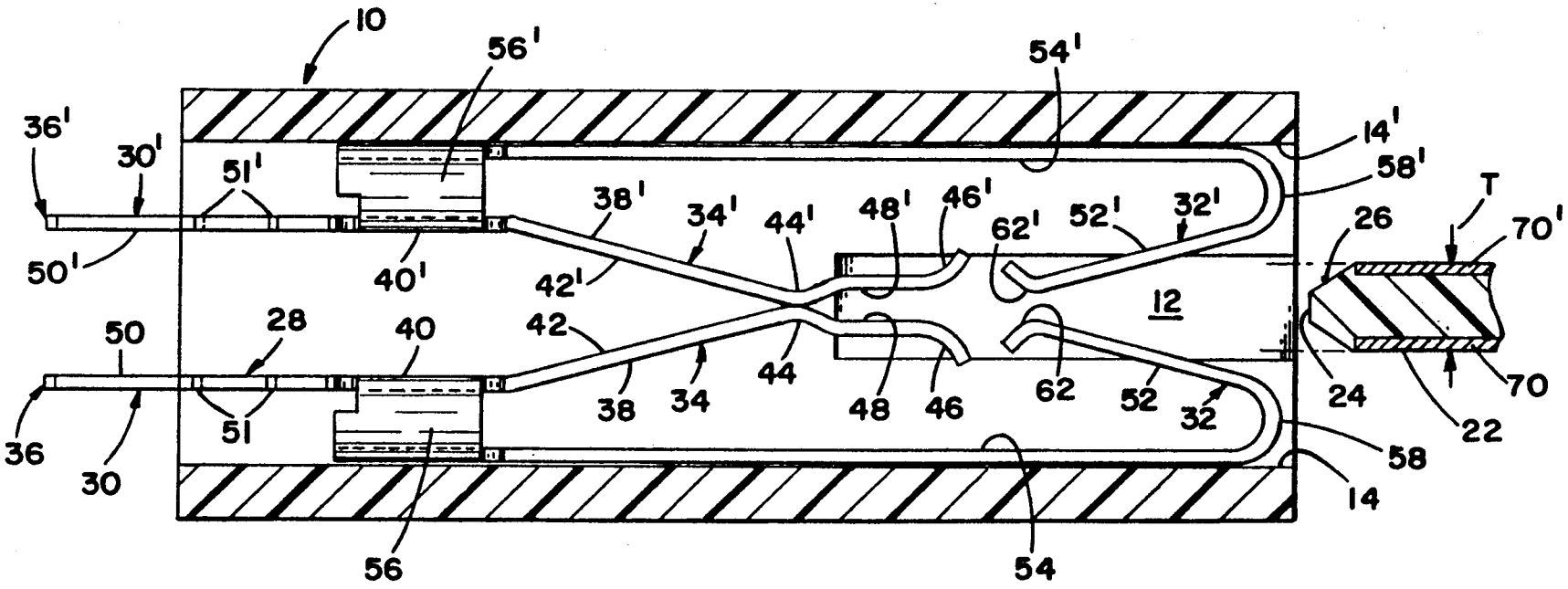
FIG. 1 is a top plan view of a make-before-break edge connector according to the present invention shown with an absence of a printed circuit board.
Figure 2:
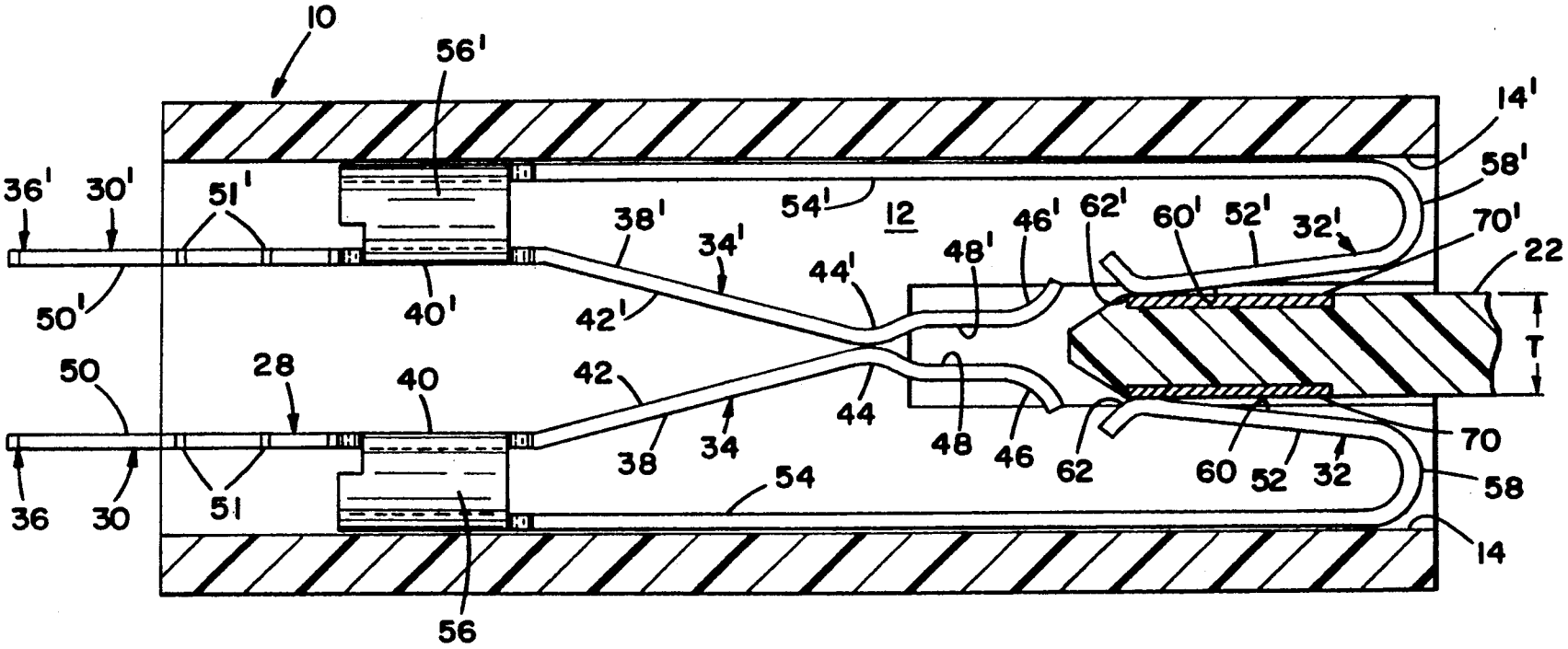
FIG. 2 is the view of FIG. 1 showing a printed circuit board partially inserted into the connector.
Figure 3:
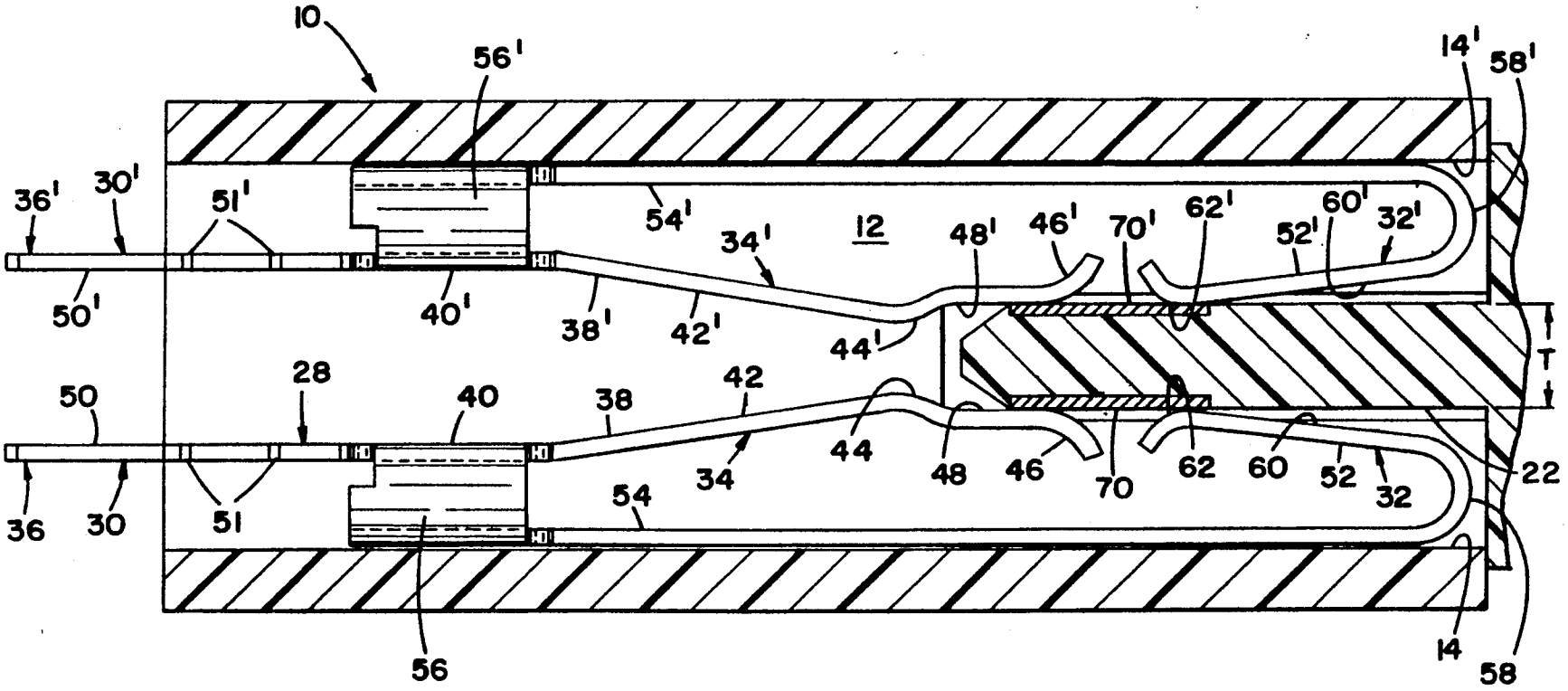
FIG. 3 is the view of FIGS. 1 and 2 with a printed circuit board fully inserted within the connector.
Figure 4:
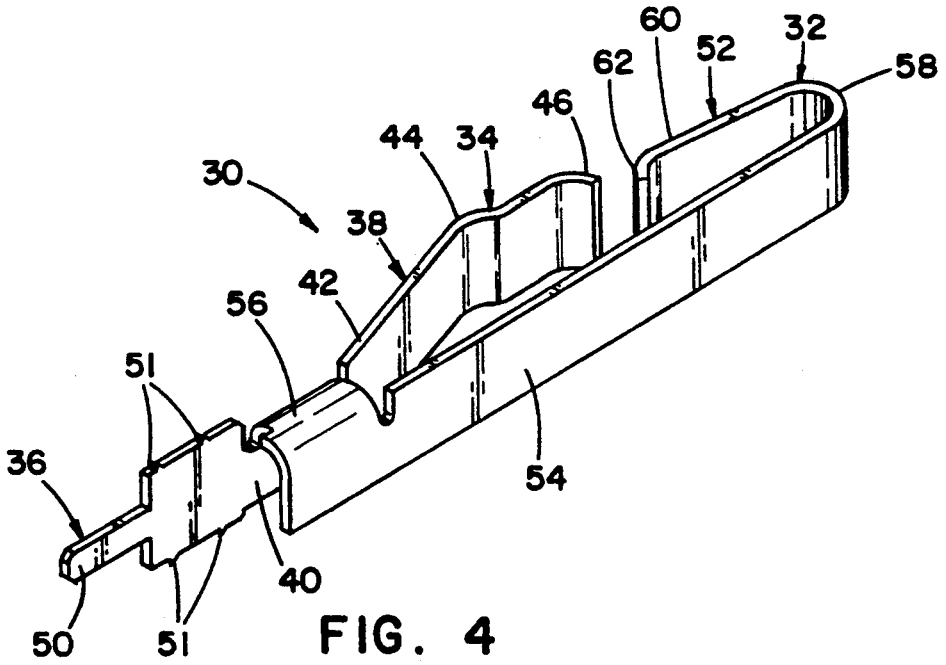
FIG. 4 is a perspective view of a spring contact for use with the present invention.

Referring now to the several drawing figures in which identical elements are number identically throughout, a description of the preferred embodiment of the present invention will now be provided. With reference to FIGS. 1-3, a housing 10 of insulating material is shown. The housing 10 includes a cavity 12 defined, at least in part, by housing side walls 14,14'. The housing may include rear, top and bottom walls (not shown), which are not shown to facilitate a description of the invention.

As shown, side walls 14,14' are generally parallel and spaced apart. The housing 10 does not have a forward wall such that cavity 12 is exposed directly to the interior through a forward end of the housing 10. As a result, a printed circuit board 22 may be inserted within the cavity 12. The printed circuit board has a predetermined thickness, T. Also, at a leading edge 24 the printed circuit board is provided with a taper (shown at 26 in FIG. 1).

The housing 10 includes connector 28. The connector 28 includes first and second opposing spring contacts 30,30'. As shown best in FIG. 1, the spring contacts 30,30' are disposed as an opposing pair. Each is formed of electrically conductive material.

As is apparent from the drawings, each of contacts 30,30' is a mirror image of the other. Accordingly, a description of contact 30 will suffice as a description of contact 30'. Identical elements are numbered identically except of the addition of the apostrophe for the elements of contact 30'.

The contacts include an entrance end 32, an intermediate portion 34 and a termination end 36. The intermediate portion 34 includes a normally closed spring contact 38. The spring contact 38 includes a body portion 40 and a spring portion 42. Within cavity 12, the normally closed spring contacts 38,38' are disposed with their body portions 40,40' spaced apart. The spring portions 42,42' are resiliently biased into electrical contact at contact points 44,44'.

The spring portions also include receiving ends 46,46'. Spring portions 46,46' are shown to flare outwardly away from contact points 44,44'. The receiving ends 46,46' include cam surfaces 48,48' which (when contact points 44,44' are in physical contact) are spaced apart a spacing less than the predetermined thickness T of the printed circuit board 22.

At termination ends 36,36', the first and second contacts 30,30' also include terminating members 50,50'. In the preferred embodiment, the terminating members 50,50' are in the form of wire wrap pins. Barbs 51,51' on body 40,40' hold the contacts 30,30' in the plastic housing.

Disposed at the entrance end 32, the first and second contacts 30,30' include normally open spring contacts 52,52'. The normally open spring contacts include support arms 54,54' which are connected to the body portions 40,40' by transverse spacers 56,56'.

At the entrance end 32, the support arms 54,54' bend over at points 58,58' to define open spring portions 60,60'. The spring portions 60,60' are provided with contact points 62,62'. As shown in FIG. 1, the spring portions 60,60' are resiliently biased toward one another but are formed such that at a rest position (such as shown in FIG. 1) the contact points 62,62' are spaced apart by a spacing less than the predetermined thickness T.

Also shown in FIG. 1, the support arms 54,54' are generally parallel and are formed to snugly fit within the cavity with the arms 54,54' biased into abutting relation with walls 14,14' substantially along the entire length of portions 54,54'. The lengths of portions 54,54' are selected to extend from the entrance end 32 to the intermediate end 30. As will be described, this provides a substantially increased bearing surface over the prior art.

The operation of the connector 28 is best shown with reference to FIGS. 2 and 3. FIG. 2 shows a printed circuit board partially inserted within the connector 28. The printed circuit board 22 separates the spring portions 60,60' by reason of separating contact portions 62,62'. The printed circuit board may include electrical contact pads 70,70' and a circuit (not shown). As a result, electrical connection is now made between contacts 62,62' and the circuit carried on the printed circuit board 22.

As is apparent from FIG. 2, upon the partial insertion of board 22 and partial deflection of spring portions 60,60', the deflection force is distributed along the support portions 54,54' and bears substantially along the entire length of walls 14,14'. Also, the force is not transmitted to the normally closed spring contact portions 38,38' thereby avoiding premature separation of contact points 44,44'.

Upon further insertion of the printed circuit board to a fully inserted position (shown in FIG. 3), the leading edge 24 of the printed circuit board 22 passes between the receiving portions 46 of the normally closed spring contacts 38. Since the printed circuit board 22 has a thickness T greater than the spacing between the cam surfaces 48,48', the receiving portions 46,46' are spread apart upon insertion of the printed circuit board 22. This spreading results in separation of the contact points 44,44'. As a result, the electrical circuit directly through the connector 28 is now broken.

From the forgoing description, the reader will appreciate that the make-before-break attributes of the connector 28 have been achieved. A circuit is made through the printed circuit board upon partial insertion as shown in FIG. 2. The circuit through the connector is broken upon complete insertion as shown in FIG. 3. With the absence of a printed circuit board (FIG. 1), the connector is normally closed.

Also, from the forgoing, the reader will appreciate that the objects of the invention are achieved with the present invention. Namely, due to the spacing between contacts 62,62' (shown in FIG. 1), the amount of deflection of the spring portions 60,60' is minimized upon insertion of a printed circuit board 22. This results in reduced bending at bend locations 58,58' reducing the probability of plastic deformation or breakage of the springs at these points. Further, the defection load is carried along the entire length of the support arms 54,54' which bear against a substantially increased surface area of plastic walls 14,14'. This reduces the possibility of creep or plastic deformation of walls 14,14'. As a result, premature opening of contacts 44,44' is avoided.

Figure 5:
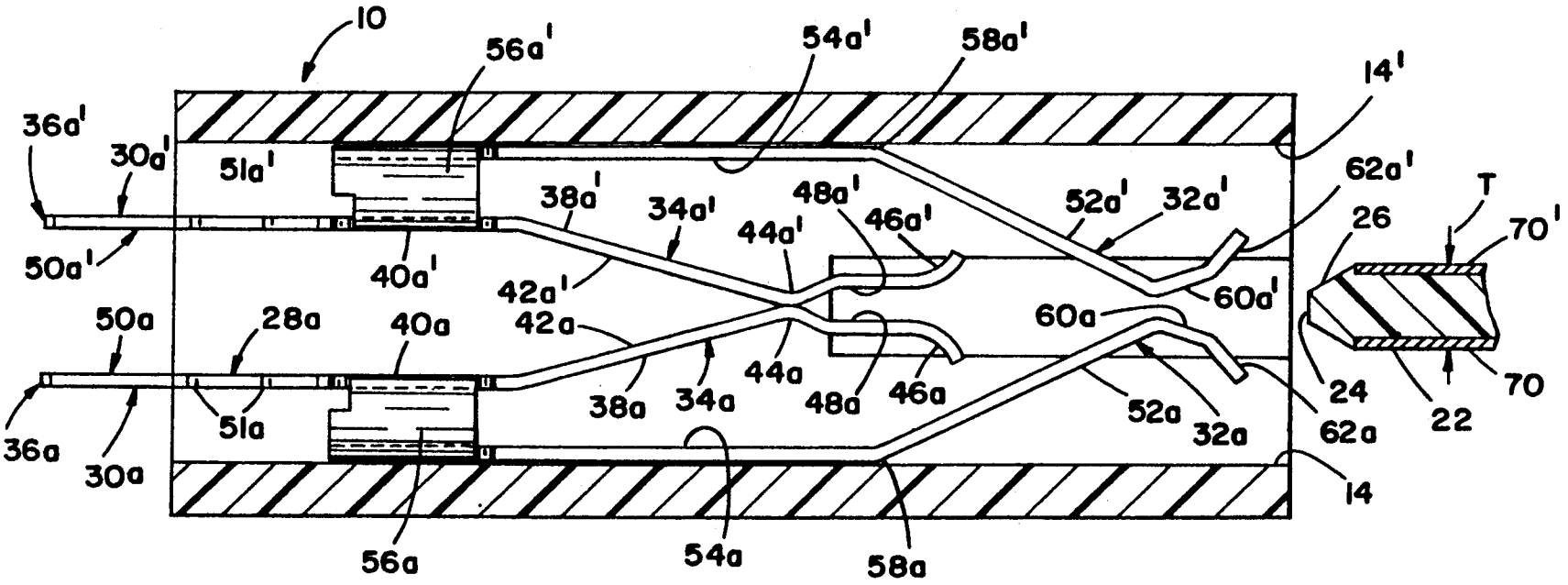
FIG. 5 is a top plan view of a make-before-break edge connector according to an alternate embodiment of the present invention shown with an absence of a printed circuit board.

FIG. 5 shows an alternative embodiment of the present invention. In FIG. 5, the opposing spring contacts 30a,30a' are similar to contacts 30,30' in that they have entrance ends 32a,32a', intermediate portions 34a,34a' and termination ends 36a,36a'. Termination ends 36a,36a' are provided with termination pins 50a,50a' having securing barbs 51a,51a'. The intermediate portions 34a,34a' include normally closed spring contacts 38a,38a'. The spring contacts 38a,38a' have body portions 40a,40a' which are spaced apart. Extending from the body portions 40a,40a' are spring portions 42a,42a' which are resiliently biased into electrical contact at contact points 44a,44a'. The spring port also include receiving ends 46a,46a' which flare outwardly away from the contact points 44a,44a'. The receiving ends 46a,46a' have cam surfaces 48a,48' which (when contact points 44a,44a' are in physical contact) are spaced apart by a spacing less than the predetermined thickness, T, of the printed circuit board.

At the entrance ends 32a,32a', the first and second spring contacts 30a,30a' include normally open spring contacts 52a,52a'. The normally open spring contacts include support arms 54a,54a' which are connected to the body portion 40a,40a' by transverse spacers 56a,56a'. The support arms 54a,54a' abut against the interior surface of the plastic housing.

The support arms 54a,54a' include an inward bend 58a,58a' from which normally open spring contacts 52a,52a' extend. At the terminal ends of the normally open spring contacts 52a,52a', the spring portion 60a,60a' are defined and are resiliently biased toward one another but are formed such that at a rest position (shown in FIG. 5), contact points 62a,62a' are spaced apart by a spacing less than the predetermined thickness of the printed circuit board. In operation, the embodiment of FIG. 5 functions similar to that of the embodiment of FIGS. 1 through 4. With the bends 58a,58a' provided inwardly from the contact points 62a,62a', the load of the spring forces is distributed internally into the plastic housing to further avoid creep and deformation at the entrance ends to the plastic housing.

Having described the present invention in a preferred embodiment, it will be appreciated that modifications and equivalents of the disclosed concepts may be made. It is intended that the scope of the present application include such modifications and equivalents as will be apparent to one of ordinary skill in the art.

What is claimed is:

1. An edge connector for receiving an edge portion of a printed circuit board of predetermined thickness, said edge connector comprising:

first and second contacts disposed as an opposing pair with each of said contacts formed of electrically conductive material;

each of said first and second contacts including an entrance end, an intermediate portion and a termination end;

each of said first and second contacts including first and second, respectively, normally closed spring contacts disposed in said intermediate portion, said first and second normally closed spring contacts each having first and second, respectively, spaced apart body portions and first and second, respectively, spring portions integrally formed with said first and second, respectively, body portions, said first and second normally closed spring portions resiliently biased into electrical contact;

each of said first and second contacts further including first and second, respectively, terminating members disposed at said termination end and electrically connected to said first and second, respectively, body portions;

each of said first and second contacted further including first and second, respectively, normally open spring contacts disposed at said entrance end, said first and second normally open spring contacts including first and second, respectively, support portions connected to said first and second, respectively, body portions and further including first and second, respectively, open spring portions disposed in spaced apart relation with a spacing selected to be less than said predetermined thickness;

said normally closed spring contacts and said normally open spring contacts mutually aligned in colinear alignment for an edge of a printed circuit board to be inserted into said edge connector with a location on said edge first passing between said first and second open spring portions and making electrical contact with said open spring portions and with said location upon further insertion of said edge, passing between and separating said first and second normally closed spring portions.

2. An edge connector according to claim 1 wherein said first and second support portions are disposed in spaced apart relation form said first and second, respectively, body portions.

3. An edge connector according to claim 1 wherein said first and second normally closed spring portions include first and second, respectively, contact locations in electrical contact when said first and second normally closed spring portions are biased into said electrical contact;

said first and second normally closed spring portions further including first and second, respectively, receiving ends, said first and second receiving ends disposed in spaced apart relation with a spacing less than said predetermined thickness when said first and second normally closed contact portions are in said electrical contact, said first and second receiving ends disposed to receive said edge portion as said edge portion is passed from said first and second normally open spring contacts toward said first and second contact locations.

4. An edge connector according to claim 2 comprising a dielectric housing having a cavity therein sized to receive said opposing pair of first and second contacts with said terminating members exposed through said housing;

said first and second support portions sized to be received abutting opposing walls of said housing.

* * * * *

UNITED STATES PATENT AND TRADEMARK OFFICE

CERTIFICATE OF CORRECTION

PATENT NO. : 5,286,215

DATED : February 15, 1994

INVENTOR(S) : James D. Dewey, et al.

It is certified that error appears in the above-identified patent and that said Letters Patent is hereby corrected as shown below:

In column 1, line 66, delete " ' " after the word "insulated";

In column 5, line 13, "port" should read ---portions---;

In claim 1, column 6, line 12, "contacted" should read ---contacts---;

In claim 2, column 6, line 35, "form" should read --from--; and

In claim 4, column 6, line 60, insert ---in--- after the word "received".

Signed and Sealed this

Twentieth Day of September, 1994

*Attest:*

Bruce Lehman

BRUCE LEHMAN

*Attesting Officer*

*Commissioner of Patents and Trademarks*